US005273357A

United States Patent [19]

Currie

[11] Patent Number: 5,273,357

[45] Date of Patent: Dec. 28, 1993

[54] NAIL POLISH SHAKER APPARATUS

[76] Inventor: Susan M. Currie, 28 Leland St., E. Northport, N.Y. 11731

[21] Appl. No.: 982,347

[22] Filed: Nov. 27, 1992

[51] Int. Cl.[5] ..... B01F 11/00

[52] U.S. Cl. ..... 366/110; 74/55; 366/128; 366/212

[58] Field of Search ..... 366/110, 111, 128, 197, 366/203, 208, 209, 212, 215, 219, 240, 605; 74/55, 569

[56] References Cited

U.S. PATENT DOCUMENTS

| | | | |
|---|---|---|---|
| 523,587 | 7/1894 | Muller | 366/208 X |
| 814,196 | 3/1906 | Forsyth | 366/212 |
| 989,783 | 4/1911 | Jeffris | 366/212 |
| 1,015,383 | 1/1912 | Dyer et al. | 366/212 |
| 1,204,849 | 11/1916 | Daniel | 366/212 |
| 2,109,233 | 2/1938 | Jorgenson | 366/209 |
| 3,061,280 | 10/1962 | Kraft et al. | 366/110 |
| 3,301,534 | 1/1967 | Orser . | |
| 3,735,962 | 5/1973 | Pagano . | |
| 4,061,315 | 12/1977 | Eitzen et al. | 366/208 X |
| 4,265,548 | 5/1981 | Hall . | |
| 4,316,672 | 2/1982 | Kerscher | 366/212 |
| 4,422,768 | 12/1983 | Solomon . | |
| 4,893,938 | 1/1990 | Anderson | 366/208 |

*Primary Examiner*—Harvey C. Hornsby
*Assistant Examiner*—Charles Cooley
*Attorney, Agent, or Firm*—Henderson & Sturm

[57] ABSTRACT

A shaker apparatus (10) for shaking the contents of a bottle of nail polish (100) including a bottle holder unit (15) slideably disposed on a pair of vertical guide posts (32) and operatively associated with a rotary drive unit (14) having an eccentric cam head element connected to a variable speed motor (40) for imparting a vertically reciprocating motion to a bottle of nail polish (100) disposed within the bottle holder unit (15).

4 Claims, 1 Drawing Sheet

NAIL POLISH SHAKER APPARATUS

TECHNICAL FIELD

The present invention relates to the field of agitating devices for mixing liquids in general, and in particular to a device for shaking a bottle of nail polish to uniformly mix the contents of the bottle.

BACKGROUND ART

This invention was the subject matter of Document Disclosure Program Registration No. 222262 which was filed in the U.S. Patent and Trademark Office on Mar. 16, 1989.

As can be seen by reference to the following U.S. Pat. Nos. 4,422,768; 3,735,962; 4,265,548; and 3,301,534; the prior art is replete with myriad and diverse liquid filled receptacle shakers.

While all of the aforementioned prior art constructions are more that adequate for the basic purpose and function for which they have been specifically designed, these patented devices are primarily designed to accommodate only large liquid filled receptacles such as paint cans and the like.

On the other hand the present invention is specifically designed to only accommodate discrete long necked nail polish bottles; wherein, the relatively fragile composition and small size of the glass receptacles requires special design considerations.

As most women are all too well aware the contents of a bottle of nail polish have a tendency to separate out over a period of time; and, in order to restore the contents of the nail polish bottle to its intended consistency, it is necessary to manually shake the bottle rather vigorously to accomplish the desired results.

In addition to the time and effort that must normally be devoted to this task by the average woman, there are certain women who due to age or infirmity find this chore simply to difficult to perform.

DISCLOSURE OF THE INVENTION

Briefly stated, the nail polish shaker apparatus that forms the basis of the present invention comprises in general a housing unit, a variable speed motor unit; a rotary drive unit; a support unit; and, a bottle holder unit.

In addition, the rotary drive unit engages the rear of the bottle holder unit in such a manner as to form the operative connection between the bottle holder unit and the variable speed motor unit; wherein, the support unit cooperates with the rear of the bottle holder unit to impart a vertical reciprocating motion to the bottle holder unit in response to the output of the rotary drive unit.

As will be explained in greater detail further on in the specification, this particular shaker apparatus is designed to be a small, compact, unobtrusive device that will fit in well on a woman's dressing table, vanity, or other location where she normally applied nail polish.

In addition to the compact size of the apparatus, the fact that the apparatus is designed to be powered by small batteries allows the apparatus to be portable as well, which greatly enhances its attractiveness to today's on the go type of woman.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 4:
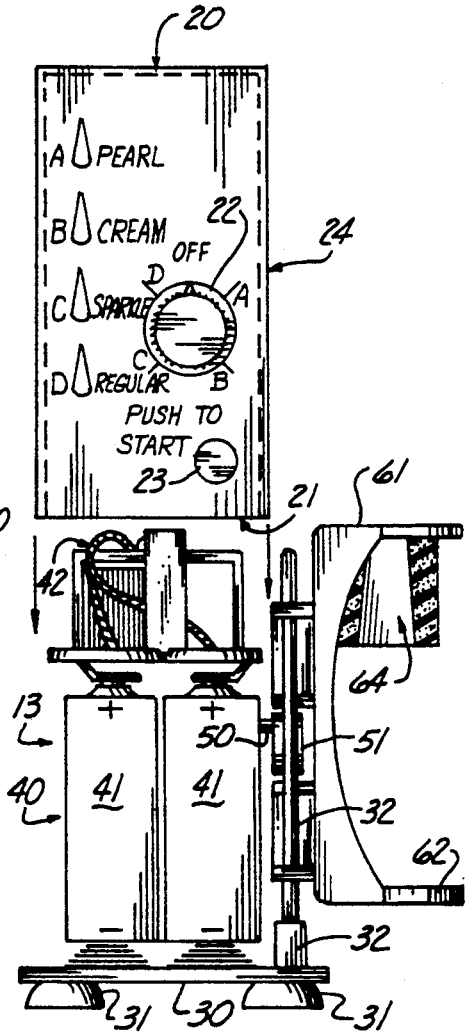
FIG. 4 is an exploded perspective view of the housing unit relative to the variable speed motor unit and the remainder of the shaker apparatus as seen from the side.
Figure 2:
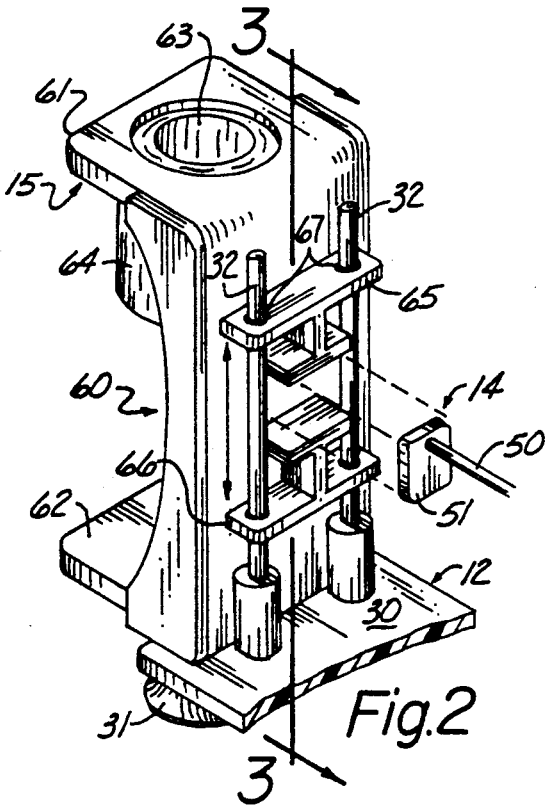
FIG. 2 is a detailed rear perspective view of the operative engagement between the bottle holder unit, the support unit and the rotary output unit.

As can be seen by reference to the drawings, and in particular to FIGS. 2 and 4, the nail polish shaker apparatus that forms the basis of the present invention is designated generally by the reference numeral (10). The shaker apparatus (10) comprises in general: a housing unit (11); a support unit (12); a variable speed motor unit (13); a rotary drive unit (14); and, a bottle holder unit (15). These units will now be described in seriatim fashion.

Figure 1:
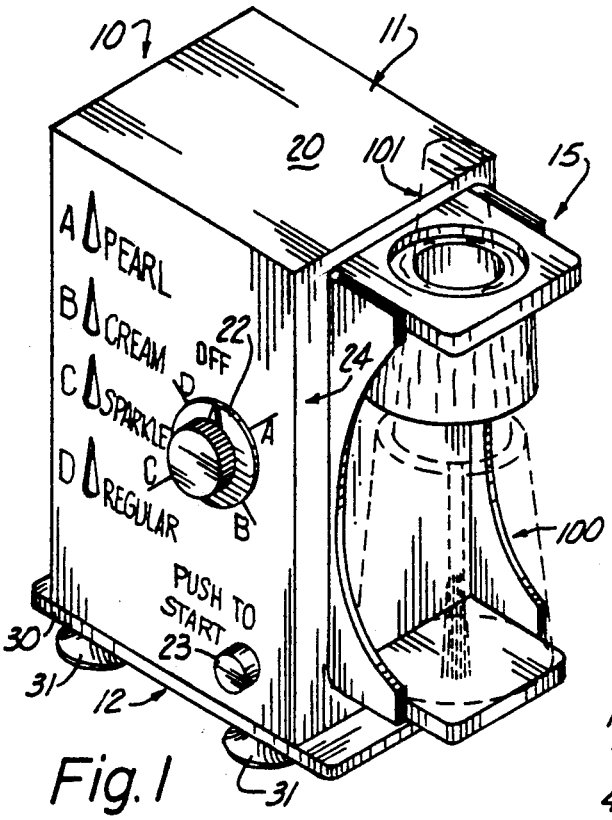
FIG. 1 is a perspective view of the nail polish shaker apparatus that forms the basis of the present invention.

As can best be seen by reference to FIGS. 1 and 4, the housing unit (11) comprises a generally rectangular housing member (20) having an open bottom (21); a plurality of control elements (22) (23); and an elongated slot (not shown) formed on the front face (24) of the housing member (20); wherein, the slot is dimensioned to receive a portion of the rotary drive unit (14), as will be explained in greater detail further on in the specification.

Figure 3:
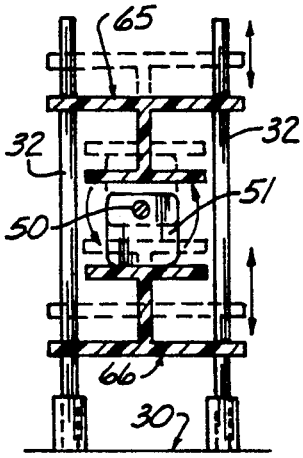
FIG. 3 is a rear plan view of the arrangement of FIG. 2.

As shown in FIGS. 2 through 4, the support unit (12) comprises an elongated generally flat rectangular base member (30) having a length which is greater than the length of the housing member (20) such that the base member (30) will project beyond the front face (24) of the housing member (20) for reasons that will be explained presently.

In addition the bottom of the base member (30) is further provided with a plurality of downwardly depending support legs in the form of suction cup elements (31); and the top of the base member (30) is provided with a pair of generally rigid elongated guide posts (32) which are positioned proximate the leading edge of the base member (30) at a point spaced from the front face (24) of the cover member (20).

As can be seen particularly be reference to FIG. 4, the variable speed motor unit (13) comprises a variable speed motor designated generally by the numeral (40); wherein, the variable speed motor (40) is powered by one or more batteries (41) which are operatively connected to the motor (40) via conventional electrical connectors (42); which are also operatively connected to the control elements (22) (23) on the housing motor (40) in a well recognized manner.

Turning now to FIGS. 2 through 4, it can be seen that the rotary output unit (14) comprises a drive shaft member (50) secured on one end to the output of the rotary motor (40) and provided on its other end with an eccentric cam head element (51); wherein, the drive shaft member (50) is dimensioned to be received in the elongated slot formed in the front face (24) of the housing member (20).

Still referring to FIGS. 2 through 4, it can be seen that the bottle holder unit (15) comprises a generally C-shaped framework member (60) having upper (61) and lower (62) outwardly projecting lips; wherein, the upper lip (61) is further provided with an enlarged aperture (63) which is aligned with a downwardly depending hollow foam collar (64), which is dimensioned to receive the tapered top (101) of a bottle of nail polish (100) when the bottom of the bottle of nail polish (100) rests on the bottom lip (62) of the framework member (60).

As can best be seen by reference to FIGS. 2 and 3, the rear surface of the framework member (60) is further provided with a pair of oppositely facing generally T-shaped flanges (65) (66) which are spaced from one another a distance greater than the longest dimension on the eccentric cam head element (51) of the drive shaft member (50).

In addition the longer cross-arms of each of the generally T-shaped flanges (65) (66) are provided with a pair of discrete apertures (67) which are dimensioned to slideably receive the guide posts (32) which project upwardly from the base member (30). Furthermore the feet of each of the generally T-shaped flanges (65) (66) are designed to function as bearing surfaces for the eccentric cam head element (51) to impart vertically reciprocating motion to the nail polish bottle holder unit (15) in response to the output of the variable speed motor (40) as selected by the control elements (22) and (23) to shake and mix the contents of the bottle of nail polish (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A shaker apparatus for use in combination with a bottle of nail polish having an elongated generally tapered top portion and a generally flat bottom portion; wherein, the shaker apparatus comprises:

a support unit including a base member having a pair of vertical guide posts formed proximate one end;

a variable speed motor attached to said base member;

a rotary output unit including a drive shaft having one end connected to said motor; wherein, the other end of the drive shaft is provided with an eccentric cam head element; and, a bottle holder unit including a framework member dimensioned to receive said bottle of nail polish; wherein the framework member is provided with a pair of oppositely faced generally T-shaped flanges which are slideably disposed on said pair of guide posts, said flanges being engageable with said eccentric cam head element for imparting vertically reciprocating motion to said bottle of nail polish; and, wherein the flanges are spaced from one another a distance that is greater than a longest dimension of said eccentric cam head element; said cam head element being disposed in between said flanges.

2. The shaker apparatus as in claim 1 further including a housing member provided with at least one control element connected to said variable speed motor for selectively governing the variable speed motor.

3. The shaker apparatus of claim 2; wherein, the framework member has an upper outwardly projecting lip and a lower outwardly projecting lip.

4. The shaker as in claim 3; wherein, the upper lip of the framework member is provided with an aperture that is dimensioned to receive the top of the bottle of nail polish when the bottom of the bottle of nail polish rests on the lower lip of the framework member.

* * * * *